US009945379B2

(12) United States Patent
Branch et al.

(10) Patent No.: US 9,945,379 B2
(45) Date of Patent: Apr. 17, 2018

(54) DISCHARGE PORT OF A SCREW COMPRESSOR

(71) Applicant: TRANE INTERNATIONAL INC., Davidson, NC (US)

(72) Inventors: Scott Michael Branch, Tomah, WI (US); Gordon Powell, Jr., Stoddard, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/028,508

(22) PCT Filed: Oct. 10, 2014

(86) PCT No.: PCT/US2014/060133

§ 371 (c)(1),
(2) Date: Apr. 11, 2016

(87) PCT Pub. No.: WO2015/054632

PCT Pub. Date: Apr. 16, 2015

(65) Prior Publication Data

US 2016/0265529 A1 Sep. 15, 2016

Related U.S. Application Data

(60) Provisional application No. 61/890,090, filed on Oct. 11, 2013.

(51) Int. Cl.

| | |
|---|---|
| ***F04C 18/16*** | (2006.01) |
| ***F04C 29/12*** | (2006.01) |
| ***F01C 21/10*** | (2006.01) |

(52) U.S. Cl.

CPC ..... *F04C 18/16* (2013.01); *F01C 21/108* (2013.01); *F04C 29/12* (2013.01)

(58) Field of Classification Search

CPC ..... F01C 21/108; F01C 1/16; F04C 18/16; F04C 29/12

(Continued)

(56) References Cited

U.S. PATENT DOCUMENTS

| | | | |
|---|---|---|---|
| 2,480,818 | A | 8/1949 | Whitfield |
| 3,622,256 | A | 11/1971 | Borisoglebsky et al. |

(Continued)

FOREIGN PATENT DOCUMENTS

| | | | |
|---|---|---|---|
| CN | 1556899 | A | 12/2004 |
| CN | 1678830 | A | 10/2005 |

(Continued)

OTHER PUBLICATIONS

Chinese Office Action, Chinese Patent Application No. 201480055921.6, dated Apr. 19, 2017 with brief English translation (10 pages).

(Continued)

*Primary Examiner* — Mark Laurenzi
*Assistant Examiner* — Paul Thiede
(74) *Attorney, Agent, or Firm* — Hamre, Schumann, Mueller & Larson, P.C.

(57) ABSTRACT

An improved discharge port of a rotary screw compressor is described. A discharge port of a screw compressor generally includes a restrictive portion to help prevent a leakage of working fluid back to a suction side of the compressor. The improved discharge port is configured to have a restrictive portion with a reduced size compared to a restrictive portion of a conventional discharge port, resulting in an enlarged opening of the discharge port compared to a conventional discharge port. The improved discharge port can help discharge the compressed working fluid more quickly than a conventional discharge port, reducing and/or avoiding over-compression of the working fluid. The efficiency gained due (Continued)

to the enlargement of the opening may be more than the efficiency loss due to leakage of working fluid back to the suction side, resulting in a net efficiency gain of the compressor.

11 Claims, 7 Drawing Sheets

(58) Field of Classification Search
USPC ..... 418/1, 194, 83
See application file for complete search history.

(56) References Cited

U.S. PATENT DOCUMENTS

| | | | | |
|---|---|---|---|---|
| 4,560,333 | A | 12/1985 | Fujiwara et al. | |
| 4,564,346 | A | 1/1986 | Kimmons et al. | |
| 4,963,079 | A * | 10/1990 | Fujiwara | F01C 1/16 418/194 |
| 5,051,077 | A | 9/1991 | Yanagisawa et al. | |
| 5,269,667 | A | 12/1993 | Mauney et al. | |
| 6,422,846 | B1 | 7/2002 | Zhong et al. | |
| 6,585,503 | B2 | 7/2003 | Okada et al. | |
| 6,692,243 | B1 | 2/2004 | Rousseau | |
| 6,705,849 | B2 | 3/2004 | Zhong et al. | |
| 6,821,098 | B2 | 11/2004 | Lifson | |
| 7,896,629 | B2 | 3/2011 | Ignatiev et al. | |
| 2002/0051722 | A1 | 5/2002 | Okada et al. | |
| 2004/0013555 | A1 | 1/2004 | Zhong et al. | |
| 2004/0042921 | A1 | 3/2004 | Rousseau | |
| 2011/0262290 | A1 | 10/2011 | Lifson | |

FOREIGN PATENT DOCUMENTS

| | | | |
|---|---|---|---|
| CN | 1678831 | A | 10/2005 |
| CN | 102046980 | A | 5/2011 |
| CN | 202250878 | U | 5/2012 |
| JP | 56-18091 | A | 2/1981 |
| JP | 2000-283079 | | 10/2000 |
| JP | 2011-27028 | A | 2/2011 |

OTHER PUBLICATIONS

Rinder, Laurenz, "Schraubenverdichter", Wien, New York: Springer, 1979, pp. 102-107, with partial machine translation.
International search report for International Application No. PCT/US2014/060133, dated Jan. 23, 2015 (3 pages).
Written opinion for International Application No. PCT/US2014/060133, dated Jan. 23, 2015 (7 pages).

* cited by examiner

DISCHARGE PORT OF A SCREW COMPRESSOR

FIELD

The disclosure herein relates to a rotary type compressor, such as a rotary screw compressor, which can be used in, for example, a heating, ventilation, and air-conditioning ("HVAC") system. More specifically, the disclosure relates to a discharge port configuration of a rotary screw compressor, which may help increase efficiency of the rotary screw compressor.

BACKGROUND

A screw compressor is a type of positive displacement compressor that can be used to compress various working fluids, such as for example refrigerant vapor. The screw compressor typically includes one or more rotors. During operation, the working fluid (e.g. refrigerant vapor) can be compressed, for example, in a pocket formed between the rotors, and the compressed working fluid can then be discharged from a discharge port at an axial end of the rotors.

SUMMARY

An improved discharge port of a rotary screw compressor is described. A discharge port of a screw compressor is generally configured to allow discharge of a compressed working fluid (e.g. compressed refrigerant) while reducing leakage of the compressed working fluid back to a suction side of the compressor. For example, a bearing housing of the compressor, which is generally configured to cover an axial end of the compressor rotors, can have an opening that helps make up a discharge port to allow the discharge of the compressed working fluid. The opening of the discharge port can also be shaped and/or sized by a restrictive portion (e.g. a tongue like portion to cover a leakage area formed by rotors of the compressor) of the bearing housing, which can help prevent leakage of working fluid back to a suction side of the compressor, such as for example, through the leakage area between the rotors of the screw compressor. Generally, the size of the opening can affect a speed of the discharge of the compressed working fluid through the opening of the discharge port. Over-compression of the working fluid can happen when the compressed working fluid is not discharged fast enough through the opening, which may reduce efficiency of the compressor. Over-compression can happen, for example, when tip speeds of the rotors are relatively high (e.g. about or at 30 m/s).

The improved discharge port may be configured generally to have a restrictive portion with a reduced size compared to a conventional discharge port, resulting in an enlarged size of the opening compared to a conventional discharge port. The improved discharge port can help discharge the compressed working fluid more quickly than a conventional discharge port, reducing and/or avoiding undesired over-compression of the working fluid.

In some embodiments, a screw compressor with the improved discharge port may include a first rotor including a lobe that has a tip and a root, a second rotor including a groove that has a top and a bottom. The lobe can be received by the groove. The screw compressor may also include a discharge port positioned between the first and second rotors about where the lobe moves toward the groove during operation.

The discharge port may include a first open area and a second open area. The first open area may include a first distal edge and a first proximal edge defining the first open area. The first distal edge may be configured to follow a portion of a track of the tip of the lobe and the first proximal edge may be configured to follow a portion of a track of the root of the lobe during operation.

The second open area may include a second distal edge and a second proximal edge defining the second open area. The second distal edge may be configured to follow a portion of a track of the top of the groove and the second proximal edge is configured to follow a portion of a track of the bottom of the root during operation. The discharge port includes a restrictive portion that is positioned between the first open area and the second open area about where the lobe moves toward the groove during operation, and the restrictive portion may be positioned away from where the lobe and the groove initially contact during a discharge cycle.

In some embodiments, the restrictive portion may be configured to cover a leakage area formed by the lobe and the groove in less than the entire discharge cycle.

In some embodiments, the restrictive portion may be configured to cover a leakage area formed by the lobe and the groove during less than about 80% of the entire discharge cycle.

In some embodiments, the restrictive portion may include a first edge contour, a second edge contour and a connecting edge contour, and the first edge contour and the second edge contour are connected by the connecting edge contour. In some embodiments, the connecting edge contour may be positioned away from where the lobe and the groove initially contact during the discharge cycle.

In some embodiments, the improved discharge port increases an area for discharging the compressed working fluid through the discharge port that can help reduce and/or avoid over-compression, while allowing some leakage of working fluid back to the suction side. When the efficiency loss due to the leakage of working fluid back to the suction side is relatively small (for example, when the leakage flow rate was about 0.025% of the full compressor flow), the efficiency gain due to the enlarged size of the discharge port can be more than the efficiency loss due to the leakage, resulting in a net efficiency gain of the compressor during operation.

Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

FIG. 3A is an end view of a screw compressor with two rotors and the discharge port when a discharge cycle is about to start. FIG. 3B is a partial enlarged end view of the screw compressor at about a middle of the discharge cycle. FIG. 3C illustrates a partial perspective bottom view of a bearing housing including the discharge port.

FIG. 4A is an end view of a screw compressor with two rotors and the improved discharge port when the discharge cycle is about to start. FIG. 4B is a partial enlarged end view of the screw compressor when a leakage area between the rotors may cause substantial working fluid leakage back to the suction side and has to be covered by a restrictive portion. FIG. 4C is a partial perspective bottom view of a bearing housing including the improved discharge port.

FIG. 5A illustrates a comparison of the geometry of a conventional discharge port and the geometry of an improved discharge port as described herein. FIG. 5B illustrates a comparison of pressure/volume diagram of a working fluid in a screw compressor with the conventional discharge port and a screw compressor with the improved discharge port.

DETAILED DESCRIPTION

Figure 1:
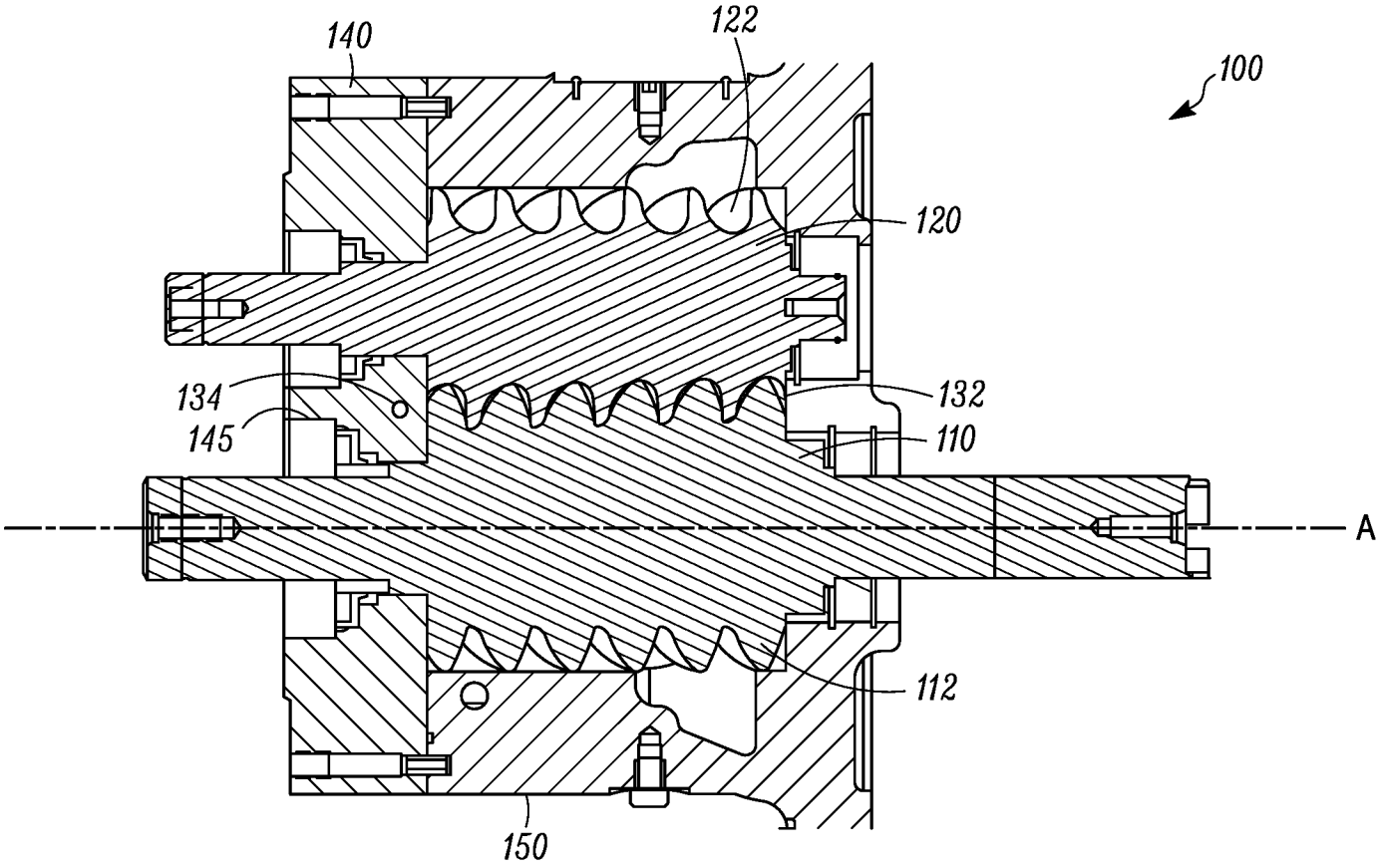
FIG. 1 illustrates a partial sectional view of a screw compressor, with which the embodiments as disclosed herein can be practiced.

A rotary screw compressor typically includes one or more rotors. FIG. 1 illustrates an embodiment of a positive-displacement screw compressor 100 with a first helical rotor 110 and a second helical rotor 120. The first helical rotor 110 has a plurality of spiral lobes 112 (i.e. the male rotor) that can be received by a plurality of spiral grooves 122 of the second helical rotor 120 (i.e. the female rotor).

The first and second helical rotors 110 and 120 are housed in a rotor housing 150. During operation, the first and second helical rotors 110 and 120 rotate. Relative to an axial direction that is defined by an axis A of the first helical rotor 110, the screw compressor 100 has an inlet port 132 and an outlet port 134. The rotating first and second helical rotors 110 and 120 can intake a working fluid (e.g. refrigerant vapor) at the inlet port 132. The working fluid can be compressed between the lobes 112 and the grooves 122 in the pocket, and discharged at the outlet port 134.

The rotor housing 150 for the helical rotors 110 and 112 is covered by a bearing housing 140 at an axial end of the rotor housing 150. The bearing housing 140 has an end plate 145 that is positioned proximate the outlet port 134. The end plate 145 can include an opening (not shown in FIG. 1, but see, for example, the opening 230 of the discharge port 231 in FIG. 2) that helps make up a discharge port, which can allow the compressed working fluid to be discharged from the rotor housing 150 to the bearing housing 140.

Figure 2:
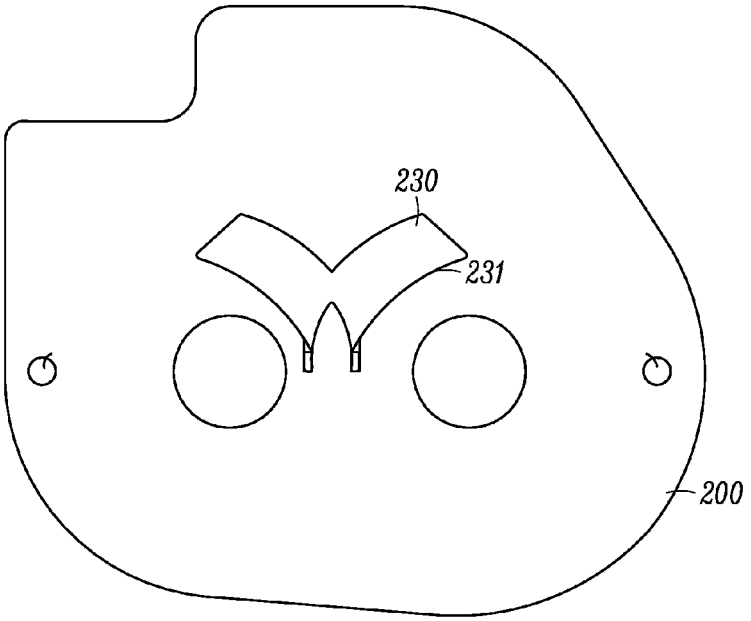
FIG. 2 illustrates a bearing house plate including a discharge port that can be used in a screw compressor.

The opening of the discharge port on the end plate 145 can be configured to have a specific shape and/or size. FIG. 2 illustrates an exemplary opening 230 of an axial discharge port 231. The term "axial discharge port" generally means that the discharge port is typically positioned at an axial end of the rotors (e.g. ends of the first and second helical rotors 110 and 120 in the axial direction defined by the axis A), and is configured to release the compressed working fluid through the opening 230 of the discharge port 231.

In the illustrated embodiment, the opening 230 may be encompassed by an end plate 200. It is appreciated that the end plate 200 can be configured to be removable or non-removable. The end plate 200 can be positioned at the axial end of a rotor housing (e.g. the rotor housing 150 of the screw compressor 100) next to rotors (e.g. the first and second helical rotors 110 and 120), so that the compressed working fluid can generally be discharged through the opening 230 of the discharge port 231.

Figure 3A:
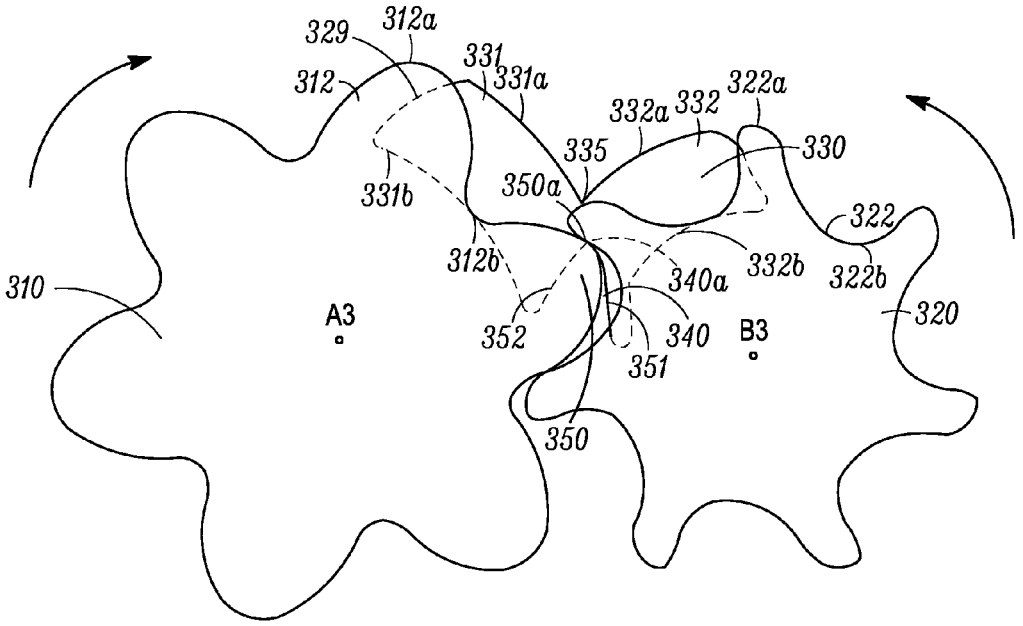
FIG. 3A (PRIOR ART)
FIGS. 3A to 3C illustrate a discharge port of a conventional design.
Figure 3B:
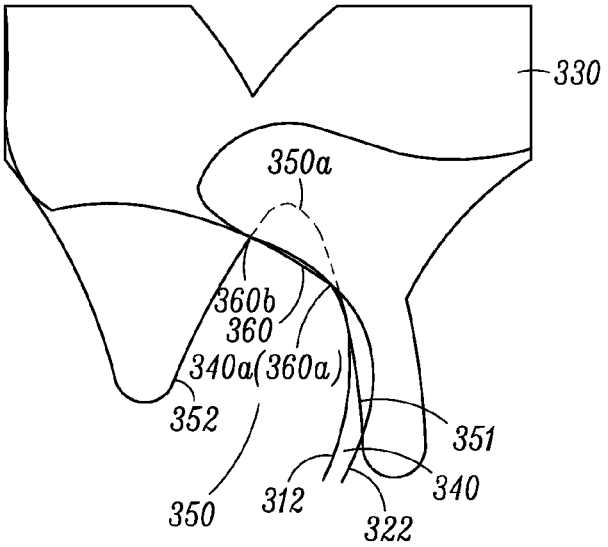
FIG. 3B (PRIOR ART)
Figure 3C:
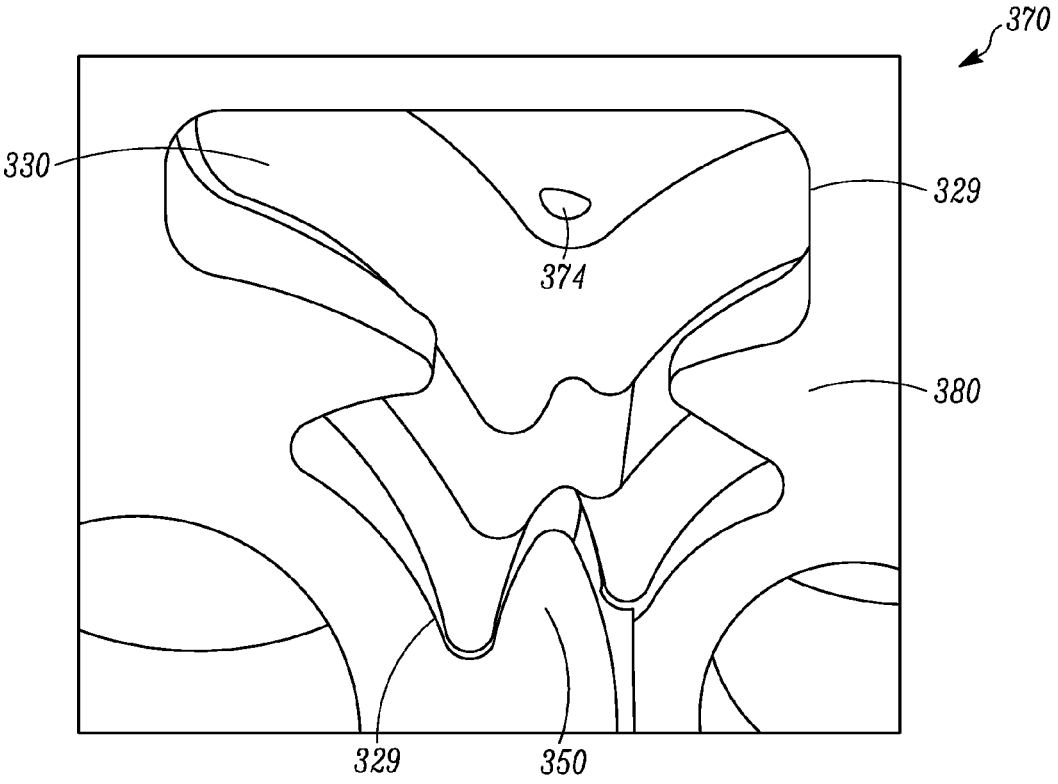
FIG. 3C (PRIOR ART)

FIGS. 3A to 3C describe an opening 330 of an axial discharge port 329 of a conventional design. Generally, the opening 330 is placed in a compressor and shaped and/or sized so that a compressed working fluid can generally be discharged through the opening 330 of the discharge port 329, after being compressed between a first rotor 310 and a second rotor 320 of the compressor.

The first rotor 310 has a plurality of lobes 312 that can rotate around a first axis A3, and the second rotor 320 has a plurality of grooves 322 that can rotate around a second axis B3.

In the illustrated embodiment of FIGS. 3A to 3C, during operation, the first rotor 310 rotates in a clockwise direction, while the second rotor 320 rotates in a counterclockwise direction in the orientation as shown in FIGS. 3A and 3B. When the lobe 312 of the first rotor 310 is received by the groove 322 of the second rotor 320, the contours of the lobe 312 and the groove 322 can define a pocket 340.

The working fluid can be compressed between the lobes 312 and the grooves 322, and discharge through the opening 330. The compression of the working fluid by the lobes 312 and the grooves 322, and the discharge of the compressed working fluid generally define a discharge cycle.

The opening 330 is generally located at where the lobe 312 and the groove 322 rotate toward each other. The opening 330 generally has a first open area 331 and a second open area 332. The first open area 331 is defined by a distal edge 331*a* and a proximal edge 331*b*. The second open area 332 is defined by a distal edge 332*a* and a proximal edge 332*b*. The terms "distal" and "proximal" are relative to the first or the second axis A3, B3. The distal edge 331*a* of the first open area 331 is further away than the proximal edge 331*b* relative to the first axis A3. The distal edge 332*a* of the second open area 332 is further away than the proximal edge 331*b* relative to the second axis B3.

The lobe 312 has a tip 312*a*, which is generally a location that is the furthest away from the axis A3 on the lobe 312. The distal edge 331*a* of the first open area 331 has a shape that generally resembles a portion of a track of the tip 312*a* when the first rotor 310 rotates toward where the lobe 312 and the groove 322 meet. The lobe 312 has a root 312*b*. The root 312*b* is generally a location that has the shortest distance from the axis A3 to the lobe 312. The proximal edge 331*b* of the first open area 331 has a shape that generally resembles a portion of a track of the root 312*b* when the first rotor 310 rotates toward where the lobe 312 and the groove 322 meet.

The groove 322 has a top 322*a*, which is generally a location that has the furthest distance from the axis B3 on the groove 322. The distal edge 332*a* of the second open area 332 has a shape that generally resembles a portion of a track of the top 322*a* when the second rotor 320 rotates toward where the lobe 312 and the groove 322 meet. The groove 322 has a bottom 322*b*, which is generally a location that has the shortest distance from the axis B3 on the groove 322. The proximal edge 332*b* of the second open area 332 has a shape that generally resembles a portion of a track of the bottom 322*b* when the second rotor 320 rotates toward where the lobe 312 and the groove 322 meet.

During operation, the distal edge 331*a* of the first open area 331 and the distal edge 332*a* of the second open area 332 meet at an intersection 335. The opening 330 is further shaped and/or sized by a restrictive portion 350 that extends toward the intersection 335. The restrictive portion 350 is generally positioned between the proximal edge 331*b* of the first open area 331 and the proximal edge 332*b* of the second open area 332.

The restriction portion 350 has a peak 350*a*, which generally is a location of the restriction portion 350 that has the closest distance from the intersection 335. Referring to FIG. 3A, the peak 350*a* generally extends to where a trailing end 340*a* of the pocket 340 is when the pocket 340 is initially formed by the contours of the lobe 312 and the groove 322 during operation. In the illustrated embodiment, the trailing end 340*a* is where the pocket 340 ends in a counterclockwise orientation relative to the first axis A3.

The restriction portion 350 has a first edge contour 351 and a second edge contour 352 extending from the peak 350*a* of the restriction portion 350 in a direction that is away from the intersection 335.

Referring to FIGS. 3A and 3B, the second edge contour 352 is further defined. During operation, a leakage area 360 can be formed by the contours of the lobe 312 and the groove 322, which trails the pocket 340. The leakage area 360 can be formed due to, for example, contour design of the lobe 312 and the groove 322. In the illustrated embodiment, the leakage area 360 generally trails the pocket 340 in the counterclockwise direction relative to the first axis A3. The trailing end 340*a* of the pocket 340 is located at where a leading end 360*a* of the leakage area 360 is located. Generally, the first edge contour 351 generally continuously intersects the leading end 360*a* of the leakage area 360 during a discharge cycle.

A trailing end 360*b* of the leakage area 360 is generally where the leakage area 360 ends in the counterclockwise direction during operation relative to the first axis A3, as illustrated. The second edge contour 352 generally continuously intersects the trailing end 360*b* of the leakage area 360 in the discharge cycle.

The leading end 360*a* and the trailing end 360*b* of the leakage area 360 disappear when the lobe 312 leaves the groove 322 during operation. Generally, in the conventional design, the first edge contour 351 intersects the leading end 360*a* and the second edge contour 352 intersects the trailing end 360*b* continuously during the discharge cycle from where the leading end 360*a* or the trailing end 360*b* initially forms (as illustrated in FIG. 3A) to where the leading end 360*a* or the trailing end 360*b* finally disappear respectively during operation.

During operation, the working fluid can be compressed between the lobe 312 and the groove 322. The working fluid can be compressed because the lobe 312 and the groove 322 move toward each other. When the pocket 340 is initially formed by the engagement between the lobe 310 and the groove 320, the working fluid can be trapped in the pocket 340. (See FIG. 3A.) As the lobe 310 and the groove 320 rotate toward each other, a size of the pocket 340 can be reduced. The compressed working fluid can be discharged from the opening 330 of the discharge port 329 as the working fluid being compressed between the lobe 312 and the groove 322. The compression of the working fluid ends when the lobe 310 and the groove 320 rotate away and the pocket 340 opens.

Some of the compressed working fluid may leak to a suction side of the compressor through the leakage area 360 when the working fluid is compressed between the lobe 310 and the groove 320, which trails the pocket 340 during the discharge cycle, causing loss of compression and/or efficiency.

In the opening 330 of the conventional discharge port 231 as disclosed in FIGS. 3A to 3C, the first edge contour 351 and the second edge contour 352 of the restrictive portion 350 generally continuously intersect the leading end 360*a* and the trailing end 360*b* of the leakage area 360 respectively during the entire discharge cycle (i.e. from when the pocket 340 is initially formed to when the pocket 340 is open). The restrictive portion 350 is configured to cover the leakage area 360 immediately after when the leakage area 360 is initially formed by the engagement of the lobe 312 and the groove 322. The restrictive portion 350 is typically configured to cover the leakage area 360 continuously during the entire discharge cycle until when the leakage area 360 finally disappears. Covering the leakage area 360 during the discharge cycle can generally help reduce and/or avoid the working fluid leakage to the suction side through the leakage area 360, and therefore can typically increase the compression efficiency.

Referring to FIG. 3C, a partial perspective view of a bearing housing 370 is illustrated. The bearing housing 370 includes an end plate 380, which encompasses the opening 330 of the discharge port 329. The restrictive portion 350 helps shape and size the opening 330. The opening 330 helps make up the discharge port 329. The opening 330 allows the compressed working fluid to be discharged toward the bearing housing 370 and eventually discharged out of the compressor from an outlet 374. The bearing housing 370 can be configured to cover a rotor housing (e.g. the rotor housing 150 as illustrated in FIG. 1) of the compressor. In some situations, particularly when tip speeds of the tip 312*a* of the lobe 312 and/or the top 322*a* of the groove 322 are relatively high (such as for example more than, at or about 30 m/s), the working fluid in the pocket 340 may be over-compressed, which may cause a waste of kinetic energy of the compressor. There may be some over-compression of the working fluid due to the compressed working fluid not being discharged fast enough through the opening 330, such as for example, when the tip speeds of the tip 312*a* of the lobe 312 and/or the top 322*a* of the groove 322 are relatively high. Such an occurrence can cause the compressed working fluid to accumulate at the opening 330. The relatively high tip speeds of the tip 312*a* of the lobe 312 and the top 322*a* of the groove 322 can happen, for example, when the rotations per minute (RPM) of the first and/or second rotors 310, 320 are relatively high and/or when sizes of the first and/or second rotors 310, 320 are relatively large.

It is to be appreciated that the geometry of the opening 330, which is shaped and/or sized by the geometry of the restrictive portion 350, may be affected by the geometries of the lobe 312 and the groove 322. The illustrations in FIGS. 3A to 3C are exemplary.

Figure 4A:
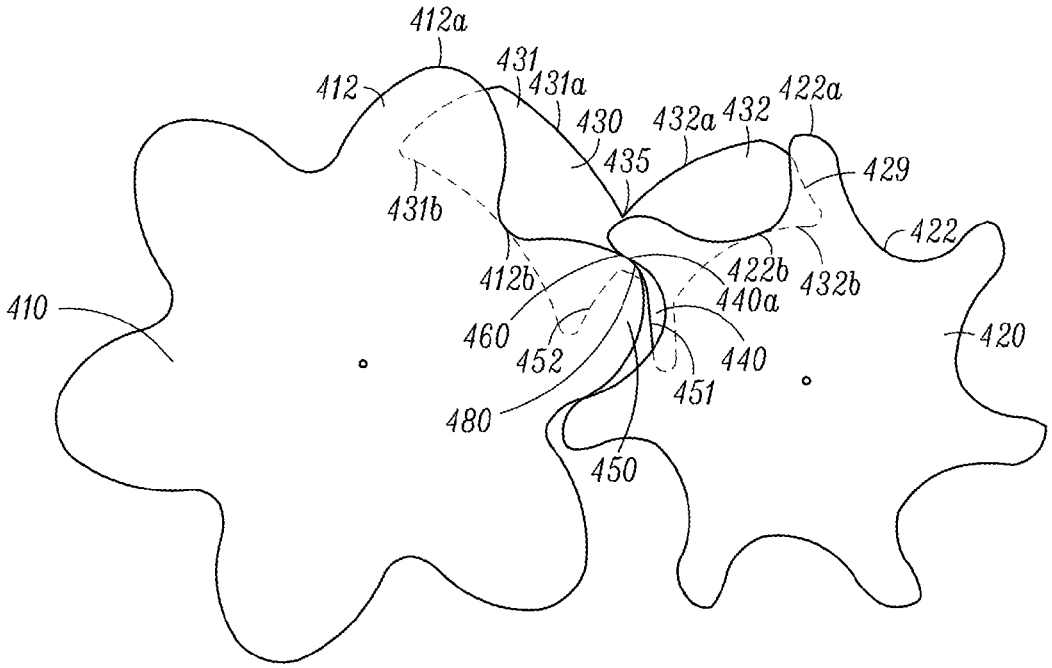
FIGS. 4A to 4C illustrate an improved discharge port as described herein, according to one embodiment.
Figure 4B:
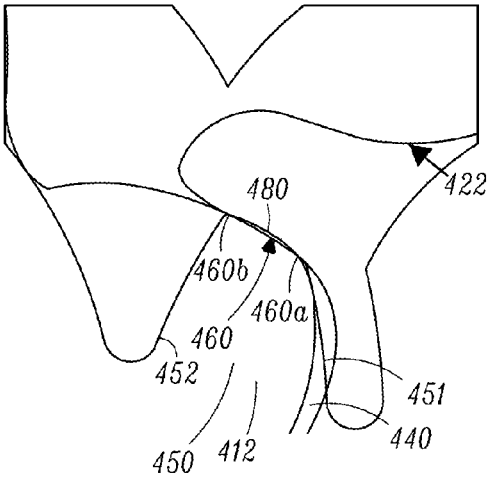
Figure 4C:
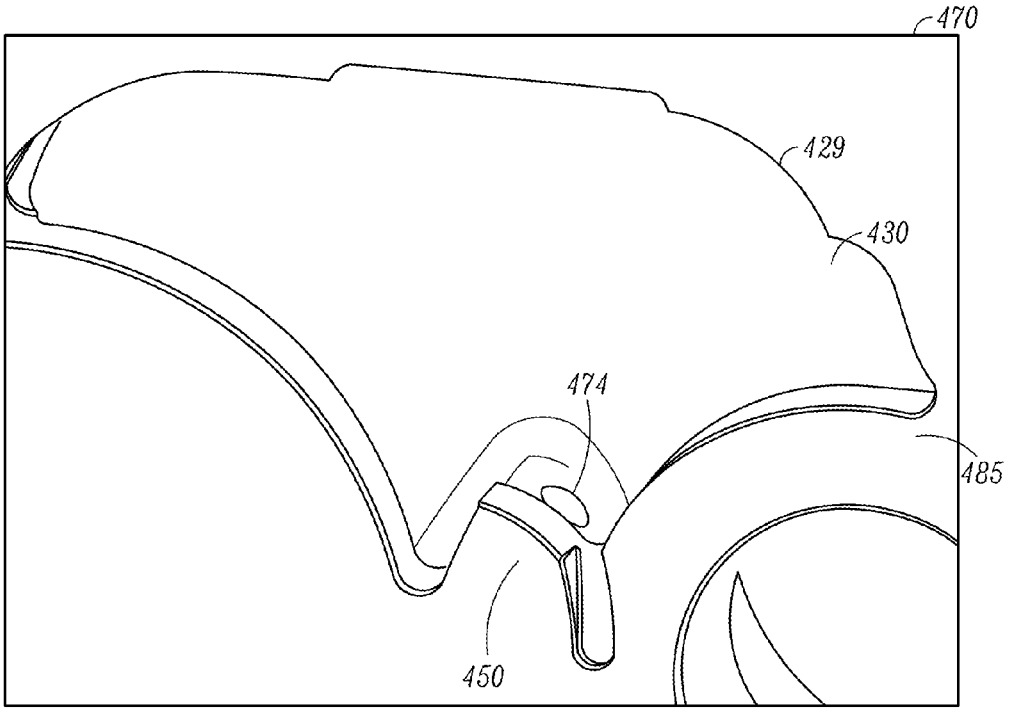

FIGS. 4A to 4C illustrate an opening 430 of an improved discharge port 429 according to one embodiment as described herein. The opening 430 may help discharge the compressed working fluid faster compared to a conventional discharge port, for example, as illustrated in FIGS. 3A and 3B (e.g. the opening 330), which may help reduce and/or avoid undesirable over-compression of the compressed working fluid.

Similar to a conventional discharge port, for example as illustrated in FIGS. 3A and 3B, the opening 430 of the improved discharge port 429 has a first open area 431 and a second open area 432. A distal edge 431*a* of the first open area 431 has a shape that generally resembles a portion of a track of a peak 412*a* of a lobe 412 of a first rotor 410 during operation. A distal edge 432*a* of the second open area 432 has a shape that generally resembles a portion of a track of a peak 422*a* of a groove 422 of a second rotor 420 during operation. The distal edge contours 431*a* and 432*a* intersect at an intersection 435.

A proximal edge 431*b* of the first open area 431 has a shape that generally resembles a portion of a track of a root

412*b* of the lobe 412 during operation. A proximal edge 432*b* of the second open area 432 has a shape that generally resembles a portion of a track of a bottom 422*b* of the groove 422.

The opening 430 is further shaped and/or sized by a restrictive portion 450, which includes a connecting edge contour 480, a first edge contour 451 and a second edge contour 452. The first edge contour 451, the second edge contour 452 and the connecting edge contour 480 help define the restrictive portion 450. The restrictive portion 450 is generally positioned between the proximal edge 431*b* of the first open area 431 and the proximal edge 432*b* of the second open area 432. The connecting edge contour 480 is a portion of the restrictive portion 450 that connects the first edge contour 451 and the second edge contour 452.

During operation, the lobe 412 engages the groove 422 to form a pocket 440. The connecting edge contour 451 of the restrictive portion 450 is configured to be positioned away from where a trailing end 440*a* of the pocket 440 is when the pocket 440 is initially formed. When the pocket 440 is initially formed, the restrictive portion 450 is generally configured to not cover a leakage area 460 that trails the pocket 440. (See FIG. 4A.)

Because of, for example, the design of contours of the lobe 412 and the groove 422, the leakage area 460 trailing the pocket 440 may be formed by the lobe 412 and the groove 422. The restrictive portion 450 is configured to be away from the leakage area 460 when the leakage area 460 is initially formed during the discharge cycle. (See FIG. 4A.) As a result, the restrictive portion 450 is configured to not cover the leakage area 460 when the leakage area 460 is initially formed and therefore the restrictive portion 450 is generally smaller than a restrictive portion of a conventional discharge port (e.g. the restrictive portion 350 and the opening 330 in FIGS. 3A and 3B). This allows the opening 430 to be enlarged compared to a conventional discharge port.

The leakage area 460 generally becomes larger as the first and second rotors 410 and 420 keep rotating from where the leakage area 460 is initially formed. (Compare, for example, FIG. 4A and FIG. 4B.) Generally, the larger the leakage area 460 is, the more working fluid may leak to the suction side through the leakage area 460. Leakage of working fluid to the suction side may reduce the efficiency of the compression of the working fluid by the first and second rotors 410 and 420. When the compression of the working fluid is relatively high, for example, about the end of the discharge cycle, the leakage of working fluid to the suction side can also be relatively high.

When the leakage area 460 is initially formed, the leakage area 460 is relatively small, as shown in FIG. 4A. Generally speaking, working fluid leaking back to the suction side through the leakage area 460 is relatively small and generally does not cause a significant efficiency loss of the compressor. When the working fluid leaking back to the suction side through the leakage area 460 does not cause a significant efficiency loss of the compressor, it may not be necessary to cover the leakage area 460 by the restrictive portion 450. As a result, a size of the restrictive portion 450 can be reduced so as to increase or maximize a size of the opening 430 compared to a conventional design, and can be reduced without a significant efficiency loss of the compressor, such as by potentially allowing a small amount of leakage. A relatively larger opening 430 can help the compressed working fluid to be discharged more quickly, which can help reduce and/or avoid undesired over-compression of the working fluid. Reducing the over-compression of the working fluid can help increase the compressor efficiency by reducing the kinetic energy loss due to over-compression. The effect of reducing and/or avoiding over-compression of the working fluid may be more prominent when the tip speeds of the first and/or second rotors 410, 420 are relatively high (e.g. at, about or larger than 30 m/s). In some embodiments, the efficiency gained due to the enlargement of the opening 430 can be more than the efficiency loss due to the leakage of working fluid back to the suction side caused by the reduced size of the restrictive portion 450, resulting in net efficiency gain by enlarging the opening 430. As a result, the overall efficiency of the compressor can be improved by using the improved opening 430.

The restrictive portion 450 can be configured to cover the leakage area 460 at where the leakage area 460 becomes large enough to cause substantial working fluid leaking back to the suction side through the leakage area 460, resulting in a significant compressor efficiency loss, as shown in FIG. 4B. The term "substantial working fluid leaking back to the suction side" generally is referred to a situation that the working fluid leaking back to the suction side is large enough to cause a significant compressor efficiency loss. The term "a significant compressor efficiency loss" is generally referred to a situation that the efficiency loss due to the reduction of the size of the restrictive portion 450 is larger than the efficiency gained by enlarging the size of the opening 430.

As illustrated in FIGS. 4A and 4B, the restrictive portion 450 has a first edge contour 451 and a second edge contour 452. The first edge contour 451 generally intersects a leading end 460*a* of the leakage area 460. The second edge contour 452 generally intersects a trailing end 460*b* of the leakage area 460. Different from the conventional discharge port, the first edge contour 451 and the second contour 452 intersects the leading and trailing ends 460*a*, 460*b* of the leakage area 460 in a portion of a discharge cycle.

In the restrictive portion 450, the first edge contour 451 and the second edge contour 452 are connected by the connecting edge contour 480. The connecting edge contour 480 is generally the portion of the restrictive portion 450 that extends relatively more toward the intersection 435. The connecting edge contour 480 is positioned away from where the leakage area 460 is initially formed, as illustrated in FIG. 4A. The connecting edge contour 480 is positioned and shaped so that the restrictive portion 450 can cover the leakage area 460 when the leakage area 460 is large enough to cause substantial leakage of working fluid back to the suction side. The location and the shape of the connecting edge contour 480 generally determine when and where the leakage area 460 may start to be covered by the restrictive portion 450.

The connecting edge contour 480 is a structure of the restrictive portion 450 that has ends that generally do not continuously intersect the leading end 460*a* or the trailing end 460*b* of the leakage area 460 during the entire discharge cycle.

Referring to FIG. 4C, a partial perspective view of a bearing housing 470 with the improved opening 430 is illustrated. The restrictive portion 450 helps shape and size the opening 430. The bearing housing 470 includes an end plate 485, which encompasses the opening 430 of the discharge port 429. The opening 430 helps make up the discharge port 429. The opening 430 allows the compressed working fluid to be discharged toward the bearing housing 470 and discharged out of the compressor from an outlet 474.

Generally, rotors of a screw compressor can form a pocket to compress a working fluid and a trailing leakage area due to such as, for example, contour geometry design of the rotors. Conventionally, the leakage area is covered by a restrictive portion to reduce and/or avoid the leakage of working fluid.

A general method of configuring an improved discharge port of a screw compressor may include positioning and/or shaping a restrictive portion (e.g. the restrictive portion 450) to be away from where a leakage area (e.g. the leakage area 460) is initially formed during a discharge cycle, so that the restrictive portion does not cover the leakage area 460 during the entire discharge cycle. By positioning and/or shaping the restrictive portion away from where the leakage area is initially formed during the discharge cycle, the discharge port (e.g. the opening 430) can be enlarged compared to a conventional design (e.g. the opening 330), facilitating the discharge of the compressed working fluid. A size of the leakage area may change during the discharge cycle. The method of configuring the discharge port of the screw compressor may also include positioning and/or shaping the restrictive portion so that the restrictive portion may cover the leakage area when a size of the leakage area may cause a substantial working fluid leaking back to the suction side, so as to avoid a significant compression efficiency loss.

The improved discharge port increases an area for discharging the compressed working fluid through the discharge port, which can help reduce and/or avoid over-compression, while allowing some leakage of working fluid back to the suction side. When the efficiency loss due to the leakage of working fluid back to the suction side is relatively small, the efficiency gain due to the enlarged size of the discharge port can be more than the efficiency loss from the leakage, resulting in a net efficiency gain of the compressor during operation. The improved discharge port therefore can increase operation efficiency of the compressor.

The location and/or shape of the restrictive portion may be optimized, for example, by a computer simulation and/or lab testing. For example, a computer simulation can be used to compare the efficiency gained by enlarging the discharge port to the efficiency loss by the working fluid leaking back to the suction side. The restrictive portion can be shaped and positioned so that the difference between the efficiency gained and the efficiency loss is the largest.

The embodiments as disclosed herein are generally applicable to a screw compressor configured to have an opening to discharge compressed working fluid, and the opening may be shaped and/or sized by a restrictive portion that is configured to cover a leakage area.

Exemplary Embodiment

Figure 5A:
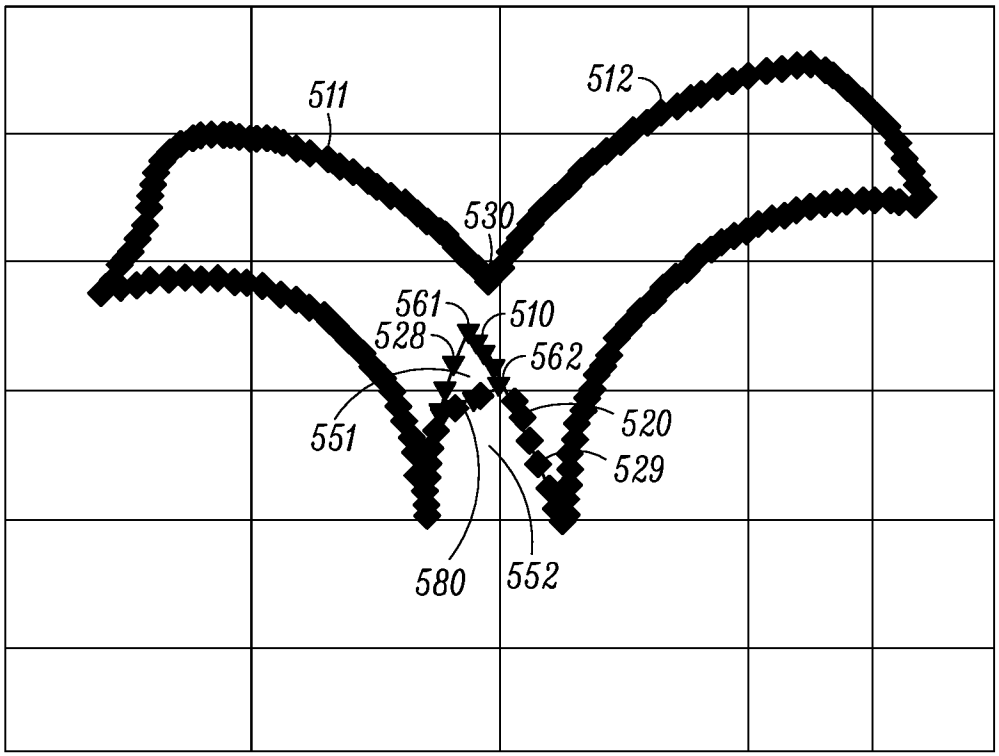
FIGS. 5A and 5B illustrate exemplary comparisons between a conventional discharge port and an improved discharge port as described herein, according to one embodiment.
Figure 5B:
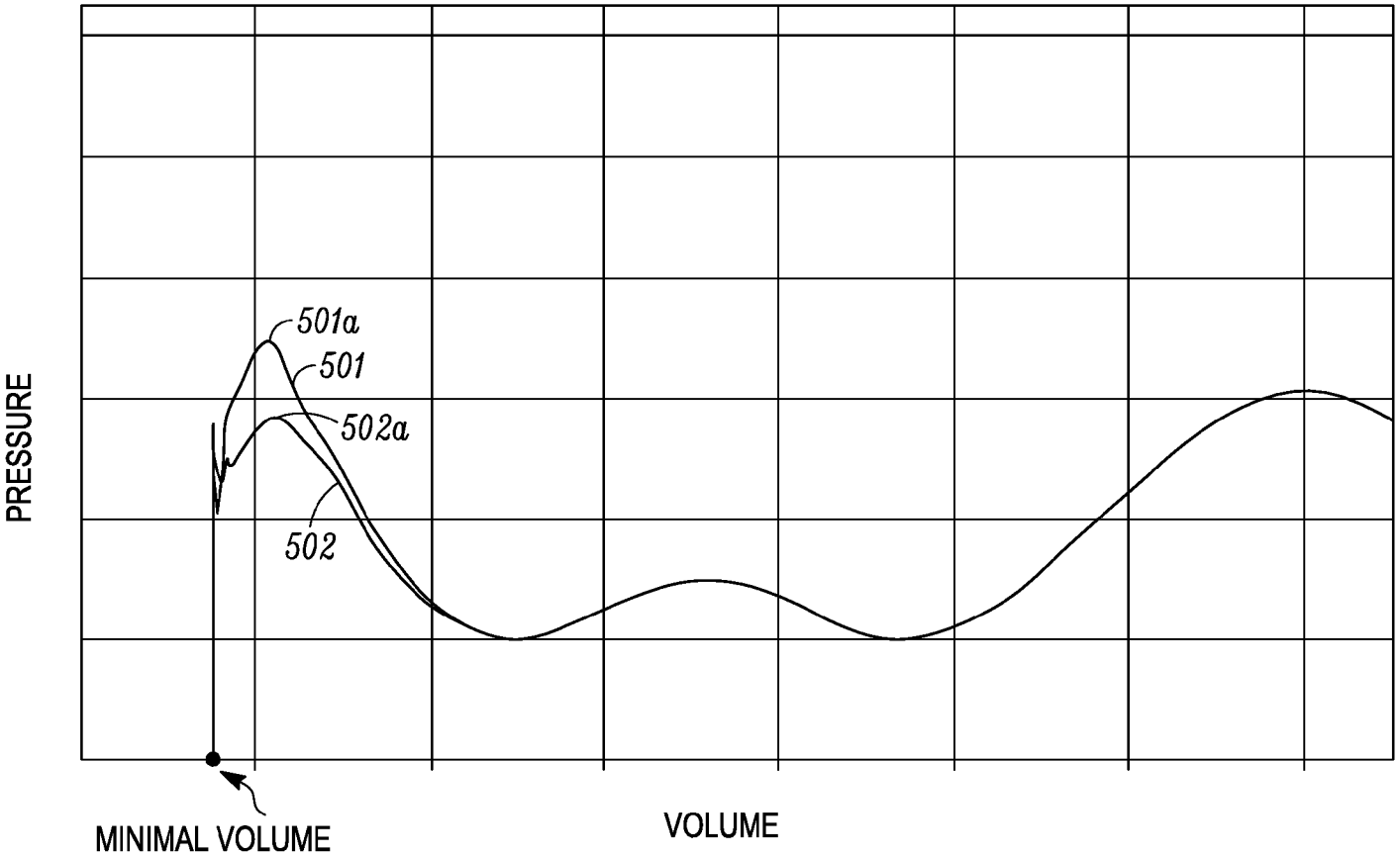

FIGS. 5A and 5B illustrate a comparison between a discharge port 510 of a conventional design and an improved discharge port 520 according to this disclosure. The conventional discharge port 510 is shaped by a conventional restrictive portion 551 and the improved discharge port 520 is shaped by an improved restrictive portion 552.

FIG. 5A illustrates a comparison between a profile of an opening 528 of the conventional discharge port 510 (which is represented by triangles in FIG. 5A) and an opening 529 of the improved discharge port 520 (which is represented by squares in FIG. 5A). The conventional discharge port 510 has a tongue-like structure, and the improved discharge port resemble a tongue-like structure with a tip portion of the tongue-like structure being chopped off.

As illustrated, the opening 528 of the conventional discharge port 510 has a similar profile as the opening 529 of the improved discharge port 520 except for the restrictive portions 551 and 552. The conventional restrictive portion 551 is generally larger than the improved restrictive portion 552. More specifically, the conventional restrictive portion 551 has a peak 561 that is closer to an intersection 530 than a peak 562 of the improved restrictive portion 552. The intersection 530 is where a first distal edge 511 and a second distal edge 512 of the discharge ports 510 and 520 respectively intersect. The peaks 561 and 562 are defined as a location on the restrictive portion 551 and 552 respectively that have the closest distance from the intersection 530.

Because the conventional restrictive portion 551 is configured to cover a leakage area between rotors when the leakage area is initially formed during a discharge cycle and relatively small in size, the peak 561 is shaped like a point. In comparison, the improved restrictive portion 552 is configured to not cover the leakage area when the leakage area is relatively small and not likely cause significant compressor efficiency loss during a relatively early portion of the discharge cycle, the improved restrictive portion 552 is configured to include a connecting edge contour 580 that is positioned and shaped to cover the leakage area when the leakage area may be large enough to cause significant compressor efficiency loss.

In the illustrated embodiment, the distance between the peak 561 and the intersection 530 is, for example, about half of the distance between the peak 562 and the intersection 530. It is to be appreciated that this is exemplary and other distances may be suitable and/or desired.

With respect to the improved restrictive portion 552, the connecting edge contour 580 is positioned and shaped to cover a leakage area (not shown in FIG. 5A, but see e.g. the leakage 460 in FIG. 4B) when the discharge cycle progresses to about 30% to about 45% of the entire discharge cycle from the initiation of the discharge cycle. The improved restrictive portion 552 is configured to keep covering the leakage area from about 30% to about 45% of the discharge cycle to an end of the discharge cycle (i.e. 100% of the discharge cycle).

FIG. 5B is a pressure/volume diagram of a working fluid in a pocket in the screw compressor. As illustrated by a curve 501, which was measured in the compressor with the conventional discharge port 510, the working fluid shows over-compression (a peak 501*a* of the curve 501) when the pocket reaches about a minimum volume, as shown in the chart. As illustrated by a curve 502, which was measured in the compressor with the improved discharge port 520, the working fluid over-compression is substantially reduced (comparing the peak 501*a* and a peak 502*a* of the curve 502) when the pocket reaches about the minimum volume. Therefore, the compressor with the improved discharge port 552 can reduce over-compression when the pocket reaches about the minimum volume. In the illustrated embodiment in FIGS. 5A and 5B, the compression efficiency gained by enlarging the improved discharge port 520 is about or at 0.3% compared to the conventional discharge port 510. The compression efficiency loss due to the reduced restrictive portion 552 is about or at 0.025%. The overall compression efficiency of the compressor with the improved discharge port 520 is higher than the compressor with the conventional discharge port 510.

Aspects

Aspect 1. A screw compressor, comprising:

a first rotor including a lobe, the lobe including a tip and a root;

a second rotor including a groove, the groove configured to receive the lobe of the first rotor during a discharge cycle, the groove including a top and a bottom; and a discharge port positioned between the first and second rotors and disposed at where the lobe moves toward the groove during the discharge cycle, the discharge port including an opening defined by a first open area and a second open area;

wherein the first open area includes a first distal edge and a first proximal edge, the first distal edge is configured to follow a portion of a track of the tip of the lobe during the discharge cycle, the first proximal edge is configured to follow a portion of a track of the root of the lobe during the discharge cycle, the second open area includes a second distal edge and a second proximal edge, the second distal edge is configured to follow a portion of a track of the top of the groove during the discharge cycle, the second proximal edge is configured to follow a portion of a track of the bottom of the root during the discharge cycle, a restrictive portion is positioned between the first open area and the second open area at where the lobe moves toward the groove during a discharge cycle, and the restrictive portion is positioned away from where the lobe and the groove initially contact during the discharge cycle.

Aspect 2. The screw compressor of aspect 1, wherein the restrictive portion is configured to cover a leakage area formed by the lobe and the groove in less than the entire discharge cycle.

Aspect 3. The screw compressor of aspects 1-2, wherein the restrictive portion is configured to cover a leakage area formed by the lobe and the groove less than 80% of an entire discharge cycle.

Aspect 4. The screw compressor of aspects 1-3, wherein the restrictive portion includes a first edge contour, a second edge contour, and a connecting edge contour, the first edge contour and the second edge contour are connected by the connecting edge contour.

Aspect 5. The screw compressor of aspect 4, wherein the connecting edge contour is positioned away from where the lobe and the groove initially contact during the discharge cycle.

Aspect 6. The screw compressor of aspects 1-5, wherein the restrictive portion is smaller than an area defined by a leading end and a trailing end of a leakage area formed by the lobe and the groove during the discharge cycle.

Aspect 7. A screw compressor, comprising:

a first rotor including a lobe, the lobe including a tip and a root;

a second rotor including a groove, the groove configured to receive the lobe of the first rotor during the discharge cycle, the groove including a top and a bottom; and a discharge port positioned between the first and second rotors at where the lobe moves toward the groove during the discharge cycle, the discharge port including an opening defined by a first open area and a second open area;

wherein the first open area includes a first distal edge and a first proximal edge, the first distal edge is configured to follow a portion of a track of the tip of the lobe during the discharge cycle, the first proximal edge is configured to follow a portion of a track of the root of the lobe during the discharge cycle, the second open area includes a second distal edge and a second proximal edge, the second distal edge is configured to follow a portion of a track of the top of the groove during the discharge cycle, the second proximal edge is configured to follow a portion of a track of the bottom of the root during the discharge cycle, a restrictive portion is positioned between the first open area and the second open area at where the lobe moves toward the groove in a compression, and the restrictive portion is configured to cover a leakage area formed by the lobe and the groove in less than the entire discharge cycle.

Aspect 8. A housing of a compressor, comprising:

an opening, the opening configured to be positioned at an axial end of rotors of the compressor; and a restrictive portion configured to shape the opening, the restrictive portion configured to cover a leakage area formed by at least one rotor of the screw compressor during a discharge cycle;

wherein the restrictive portion is positioned away from where the leakage area is initially formed during the discharge cycle.

Aspect 9. The housing of a compressor of aspect 8, wherein the restrict portion is configured to not cover the leakage area during the entire discharge cycle.

Aspect 10. A method of discharging a compressed working fluid from a compressor, comprising:

directing a compressed working fluid through an opening;

during a discharge cycle, allowing leakage of the compressed working fluid back to a suction side of the compressor when compression efficiency loss due to the leakage of the compressed working fluid back to the suction side of the compressor is less than compression efficiency gained due to allowing leakage of the compressed working fluid back to the suction side of the compressor; and during the discharge cycle, reducing the leakage of the compressed working fluid back to the suction side of the compressor when compression efficiency loss due to the leakage of the compressed working fluid back to the suction side of the compressor is larger than compression efficiency gained due to allowing the leakage of the compressed working fluid back to the suction side of the compressor.

Aspect 11. The method of aspect 10, further comprising:

during the discharge cycle, reducing the leakage of the compressed working fluid back to the suction side of the compressor when difference between the compression efficiency loss due to the leakage of the compressed working fluid back to the suction side of the compressor and the compression efficiency gain due to allowing leakage of the compressed working fluid back to the suction side of the compressor is the largest.

Aspect 12. The method of aspects 10-11, wherein reducing the leakage of the compressed working fluid back to the suction side includes covering a leakage area formed by rotors of the compressor.

Aspect 13. A method of discharging a compressed working fluid from a compressor, comprising:

directing a compressed working fluid through an opening;

during a discharge cycle, allowing leakage of the compressed working fluid back to a suction side of the compressor if allowing leakage of the compressed working fluid back to the suction side results in net efficiency gain of the compressor.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What is claimed is:

1. A screw compressor, comprising:

a first rotor including a lobe, the lobe including a tip and a root;

a second rotor including an external surface that forms a groove, the groove is configured to receive the lobe of the first rotor during a discharge cycle, the groove including a top and a bottom; and a discharge port positioned between the first rotor and the second rotor and disposed where the lobe moves toward the groove during the discharge cycle, the discharge port including an opening defined by a first open area and a second open area;

wherein the first open area is defined by a first distal edge and a first proximal edge, the first distal edge is configured to follow a portion of a track of the tip of the lobe during the discharge cycle, the first proximal edge is configured to follow a portion of a track of the root of the lobe during the discharge cycle, the second open area is defined by a second distal edge and a second proximal edge, the second distal edge is configured to follow a portion of a track of the top of the groove during the discharge cycle, the second proximal edge is configured to follow a portion of a track of the bottom of the groove during the discharge cycle, a restrictive portion is positioned between the first open area and the second open area where the lobe moves toward the groove during a discharge cycle, and the restrictive portion is positioned away from where the lobe and the groove initially contact during the discharge cycle, wherein the restrictive portion includes a first edge contour, a second edge contour, a connecting edge contour, and a peak, the first edge contour and the second edge contour are connected by the connecting edge contour, the connecting edge contour including a first end and a second end spaced apart from the first end, the peak of the restrictive portion disposed at the first end, and wherein when the second rotor rotates, the external surface also rotates such that at least a portion of the external surface that is intermediate the top and the bottom of the groove generally aligns with the connecting edge contour of the restrictive portion during the discharge cycle, and when the portion of the groove generally aligns with the connecting edge contour of the restrictive portion, the peak of the restrictive portion to the top of the groove defines a first distance, the second end of the connecting edge contour to the top of the groove defines a second distance, the first distance being less than the second distance.

2. The screw compressor of claim 1, wherein the restrictive portion is configured to cover a leakage area formed by the lobe and the groove in less than an entire discharge cycle.

3. The screw compressor of claim 1, wherein the restrictive portion is configured to cover a leakage area formed by the lobe and the groove less than 80% of an entire discharge cycle.

4. The screw compressor of claim 1, wherein the connecting edge contour is positioned away from where the lobe and the groove initially contact during the discharge cycle.

5. The screw compressor of claim 1, wherein the restrictive portion is smaller than a leakage area formed by the lobe and the groove during the discharge cycle.

6. A screw compressor, comprising:

a first rotor including a lobe, the lobe including a tip and a root;

a second rotor including an external surface that forms a groove, the groove is configured to receive the lobe of the first rotor during a discharge cycle, the groove including a top and a bottom; and a discharge port positioned between the first rotor and the second rotor where the lobe moves toward the groove during the discharge cycle, the discharge port including an opening defined by a first open area and a second open area;

wherein the first open area is defined by a first distal edge and a first proximal edge, the first distal edge is configured to follow a portion of a track of the tip of the lobe during the discharge cycle, the first proximal edge is configured to follow a portion of a track of the root of the lobe during the discharge cycle, the second open area is defined by a second distal edge and a second proximal edge, the second distal edge is configured to follow a portion of a track of the top of the groove during the discharge cycle, the second proximal edge is configured to follow a portion of a track of the bottom of the groove during the discharge cycle, a restrictive portion is positioned between the first open area and the second open area where the lobe moves toward the groove during the discharge cycle, and the restrictive portion is configured to cover a leakage area formed by the lobe and the groove in less than an entire discharge cycle, wherein the restrictive portion includes a first edge contour, a second edge contour, a connecting edge contour, and a peak, the first edge contour and the second edge contour are connected by the connecting edge contour, the connecting edge contour including a first end and a second end spaced apart from the first end, the peak of the restrictive portion disposed at the first end, and wherein when the second rotor rotates, the external surface also rotates such that at least a portion of the external surface that is intermediate the top and the bottom of the groove generally aligns with the connecting edge contour of the restrictive portion during the discharge cycle, and when the portion of the groove generally aligns with the connecting edge contour of the restrictive portion, the peak of the restrictive portion to the top of the groove defines a first distance, the second end of the connecting edge contour to the top of the groove defines a second distance, the first distance being less than the second distance.

7. The screw compressor of claim 6, wherein the first end and the second end of the connecting edge contour do not continuously intersect the leading end or the trailing end of the leakage area during the discharge cycle.

8. The screw compressor of claim 6, wherein the first end of the connecting edge contour is disposed closer than the second end of the connecting edge contour to an intersection between the first distal edge of the first open area and the second distal edge of the second open area.

9. A method of discharging a compressed working fluid from a compressor, comprising:

directing a compressed working fluid through an opening;

during a discharge cycle, allowing leakage of the compressed working fluid back to a suction side of the compressor when compression efficiency loss due to the leakage of the compressed working fluid back to the suction side of the compressor is less than compression efficiency gained due to allowing leakage of the compressed working fluid back to the suction side of the compressor; and during the discharge cycle, reducing the leakage of the compressed working fluid back to the suction side of the compressor when compression efficiency loss due to the leakage of the compressed working fluid back to the suction side of the compressor is larger than compression efficiency gained due to allowing the leakage of the compressed working fluid back to the suction side of the compressor, wherein the opening includes a first part and a second part, the first part is defined by a first distal edge and a first proximal edge, the first distal edge is configured to follow a portion of a track of a tip of a lobe of a first rotor during the discharge cycle, the first proximal edge is configured to follow a portion of a track of a root of the lobe during the discharge cycle, the second part is defined by a second distal edge and a second proximal edge, the second distal edge is configured to follow a portion of a track of a top of a groove of a second rotor during the discharge cycle, the groove is formed by an external surface of the second rotor and includes a top and a bottom, the second proximal edge is configured to follow a portion of a track of a bottom of the groove during the discharge cycle, a restrictive portion is positioned between the first part and the second part where the lobe moves toward the groove during the discharge cycle, the restrictive portion is configured to cover a leakage area formed by the lobe and the groove in less than an entire discharge cycle, the restrictive portion includes a first edge contour, a second edge contour, a connecting edge contour, and a peak, the first edge contour and the second edge contour are connected by the connecting edge contour, the connecting edge contour including a first end and a second end spaced apart from the first end, wherein when the second rotor rotates, the external surface also rotates such that at least a portion of the external surface that is intermediate the top and the bottom of the groove generally aligns with the connecting edge contour of the restrictive portion during the discharge cycle, and when the portion of the groove generally aligns with the connecting edge contour of the restrictive portion, the peak of the restrictive portion to the top of the groove defines a first distance, the second end of the connecting edge contour to the top of the groove defines a second distance, the first distance being less than the second distance.

10. The method of claim 9, wherein reducing the leakage of the compressed working fluid back to the suction side includes covering the leakage area formed by the first rotor and the second rotor of the compressor with the restrictive portion.

11. A method of discharging a compressed working fluid from a compressor, comprising:

directing a compressed working fluid through an opening;

during a discharge cycle, allowing leakage of the compressed working fluid back to a suction side of the compressor if allowing leakage of the compressed working fluid back to the suction side results in net efficiency gain of the compressor, wherein the opening includes a first part and a second part, the first part is defined by a first distal edge and a first proximal edge, the first distal edge is configured to follow a portion of a track of a tip of a lobe of a first rotor during the discharge cycle, the first proximal edge is configured to follow a portion of a track of a root of the lobe during the discharge cycle, the second part is defined by a second distal edge and a second proximal edge, the second distal edge is configured to follow a portion of a track of a top of a groove of a second rotor during the discharge cycle, the groove is formed by an external surface of the second rotor and includes a top and a bottom, the second proximal edge is configured to follow a portion of a track of a bottom of the groove during the discharge cycle, a restrictive portion is positioned between the first part and the second part where the lobe moves toward the groove during the discharge cycle, the restrictive portion is configured to cover a leakage area formed by the lobe and the groove in less than an entire discharge cycle, the restrictive portion includes a first edge contour, a second edge contour, a connecting edge contour, and a peak, the first edge contour and the second edge contour are connected by the connecting edge contour, the connecting edge contour including a first end and a second end spaced apart from the first end, wherein when the second rotor rotates, the external surface also rotates such that at least a portion of the external surface that is intermediate the top and the bottom of the groove generally aligns with the connecting edge contour of the restrictive portion during the discharge cycle, and when the portion of the groove generally aligns with the connecting edge contour of the restrictive portion, the peak of the restrictive portion to the top of the groove defines a first distance, the second end of the connecting edge contour to the top of the groove defines a second distance, the first distance being less than the second distance.

* * * * *